US006088567A

United States Patent [19]

Miyashiro et al.

[11] Patent Number: 6,088,567

[45] **Date of Patent: *Jul. 11, 2000**

[54] IMAGE FORMING DEVICE WITH DIFFERENT FIXING SPEEDS

[75] Inventors: Toshiaki Miyashiro, Shizuoka-ken; Akihiko Takeuchi, Susono; Takehiko Suzuki, Numazu; Takaaki Tsuruya, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/124,229

[22] Filed: Jul. 29, 1998

[30] Foreign Application Priority Data

Aug. 4, 1997 [JP] Japan ..... 9-209492
Jul. 21, 1998 [JP] Japan ..... 10-205084

[51] Int. Cl.[7] ..... G03G 15/00; G03G 15/16; G03G 15/20; G03G 15/01

[52] U.S. Cl. ..... 399/400; 399/66; 399/67; 399/302

[58] Field of Search ..... 399/302, 308, 399/66, 67, 68, 397, 400

[56] References Cited

U.S. PATENT DOCUMENTS 5,179,397 1/1993 Ohzeki et al. ..... 399/168 X
5,196,885 3/1993 Takeuchi et al. ..... 399/168
5,214,480 5/1993 Aoki et al. ..... 399/314
5,223,900 6/1993 Yuminamochi ..... 399/313
5,493,378 2/1996 Jamzadeh et al. ..... 399/67 X
5,508,796 4/1996 Sasame et al. ..... 399/18
5,539,507 7/1996 Miyashiro et al. ..... 399/298
5,543,904 8/1996 Kato et al. ..... 399/335
5,781,826 7/1998 Inomata ..... 399/66 X

FOREIGN PATENT DOCUMENTS 4-125676 4/1992 Japan .

*Primary Examiner*—Susan S. Y. Lee
*Attorney, Agent, or Firm*—Fitzpatrick, Cella, Harper & Scinto

[57] ABSTRACT

In an image forming apparatus a length of a transfer material in a conveying direction thereof is $L_p$, a length of a toner image transferred onto an intermediate transfer belt in a shifting direction is $L_p'$, a distance between a first transfer portion $t_1$ and a second transfer portion $t_2$ along the shifting direction of the intermediate transfer belt is $L_{t1-t2}$ and a distance between the second transfer portion $t_2$ and a fixing portion fix along the shifting direction of the transfer material is $L_{t2-fix}$, so that the following relation is established:

$$L_{t1-t2}>L_p' \text{ and } L_p>L_{t2-fix}.$$

After a first transfer is complete and before initiation of a second transfer, the speed of the intermediate transfer belt is decreased, so that, following to the second transfer process at a low speed, the toner image can be fixed onto the transfer material at a low speed. With this arrangement, the distance $L_{t2-fix}$ between the second transfer portion and the fixing portion is reduced to make the apparatus compact and the reduction of the through-put can be prevented while preventing poor fixing.

52 Claims, 5 Drawing Sheets

IMAGE FORMING DEVICE WITH DIFFERENT FIXING SPEEDS

BACKGROUND OF THE INVENTION

1. Field of the Invention

The present invention relates to an image forming apparatus in which a toner image on an image bearing member is transferred onto an intermediate transfer member, and then the toner image on the intermediate transfer member onto a transfer material.

2. Related Background Art

FIG. 5 is a schematic constructural view of a conventional image forming apparatus.

A photosensitive drum 101 formed from OPC (organic semi-conductor) is rotated in a direction shown by the arrow and a surface of the photosensitive drum is uniformly charged by a charger 102. Then, exposure corresponding to image information is effected by using an exposure device 103 having a light source 103*a* and a reflection mirror 103*b*, thereby forming an electrostatic latent image. Developing devices 104*a*, 104*b*, 104*c* and 104*d* containing yellow toner, magenta toner, cyan toner and black toner, respectively are mounted on a rotary 104A. By rotating the rotary 104A, the developing device (for example, yellow developing device 104*a*) to be used for development of the electrostatic latent image on the photosensitive drum 101 is brought to a developing station, where the toner is adhered to the electrostatic latent image to form a yellow toner image.

The yellow toner image is firstly-transferred onto an intermediate transfer belt 105*a* of an intermediate transfer device 105. The intermediate transfer belt 105*a* is wound around and extending between rollers 105*c*, 105*d* and 105*e* and is urged against the photosensitive drum 101 by a first transfer roller 105*b* to form a first transfer portion $T_1$ therebetween. The yellow toner image on the photosensitive drum 101 is firstly-transferred onto a surface of the intermediate transfer belt 105*a* by the first transfer roller 105*b* at the first transfer portion $T_1$. After the first-transferring, residual toner remaining on the surface of the photosensitive drum 101 is removed by a cleaning device 106.

Then, the above-mentioned process (charging, exposure, developing, firstly-transferring and cleaning) is repeated regarding the remaining colors, i.e., magenta, cyan and black. In this way, four color toner images are superimposed on the intermediate transfer belt 105*a*.

At a second transfer portion $T_2$, these four color toner images are collectively secondary-transferred onto a transfer material P conveyed from a sheet supply cassette 109 through a sheet supply roller 110 in a direction shown by the arrow. After the secondary-transferring, the transfer material P is conveyed, by a convey device 111, to a fixing device 112, when the four color toner images are fixed onto the transfer material with heat and pressure. Then, the transfer material is discharged onto a discharge tray (not shown). After the secondary-transferring, residual toner remaining on the surface of the intermediate transfer belt 105*a* is removed by a cleaner 108.

On the other hand, Japanese Patent Application Laid-Open No. 4-125676 discloses an image forming apparatus in which a mono-color mode and a multi-color mode can be selected in which, in the multi-color mode, a peripheral speed of an intermediate transfer member is switched from a high speed to a low speed after all color toner images were transferred from a photosensitive drum, thereby transferring the toner images onto a transfer material conveyed at a low speed. After all of the toner images on the intermediate transfer member were transferred, the intermediate transfer member is switched from the low speed to the high speed. Further, after the transferring, the toner images on the transfer material are fixed at a low speed by means of a fixing device.

However, the above-mentioned Japanese Patent Application Laid-Open No. 4-125676 does not disclose a relation between a distance from a position where the toner images are transferred from the photosensitive drum to the intermediate transfer belt to a position where the toner image are transferred from the intermediate transfer belt to the transfer material and a length of the toner image transferred onto the intermediate transfer belt, along a shifting direction of the intermediate transfer belt.

In an image forming apparatus shown in the FIG. 4, if a fixing ability for a full-color image tries to be improved, the entire apparatus will be made bulky.

In the above-mentioned image forming apparatus, a length $L_p$ of a predetermined thick sheet (105 g/cm$^2$ or more) or an OHT (transparent sheet for an overhead projector) in a conveying direction is selected to be greater than a distance $L_{T1\text{-}T2}$ from the first transfer portion $T_1$ to the second transfer portion $T_2$ along the shifting direction of the intermediate transfer belt 105*a* so that, before the firstly-transferred is completed, a tip end of the toner image reaches the second transfer portion $T_2$.

In case of a transfer material P having great heat capacity such as the predetermined thick sheet or the OHT, since the fixing condition thereof differs from the fixing condition of the normal transfer material P (105 g/cm$^2$ or less), after the full-color image was transferred onto the transfer material P, the fixing speed of the transfer material P is decreased, thereby compensating insufficient heat amount. Thus, in the image forming apparatus using the intermediate transfer belt 105*a*, after a trail end of the transfer material P passes through the second transfer portion $T_2$, the speed of the transfer material is reduced to lengthen the fixing time period, thereby obtaining the optimum fixing ability. Accordingly, a distance $L_{T2\text{-}FIX}$ between the second transfer portion $T_2$ and a fixing portion FIX of the fixing device 112 is set to be greater than the length $L_p$ of the transfer material P in the conveying direction thereof, with the result that a bulky convey device 111 must be arranged between the second transfer portion and the fixing portion, thereby making the entire apparatus bulky.

Further, after the firstly-transferring of the toner image from the photosensitive drum 101 to the intermediate transfer belt 105*a* at the first transfer portion $T_1$ is completed, before the secondary-transferring of the toner images from the intermediate transfer belt 105*a* to the transfer material P at the second transfer portion $T_2$, the intermediate transfer belt 105*a* is rotated by one revolution; meanwhile, by reducing the speed of the intermediate transfer belt 105*a*, the poor fixing can be avoided and the entire apparatus can be prevented from becoming bulky. However, when the intermediate transfer belt 105*a* is idly rotated by one revolution, the through-out of the mage formation is worsened.

The above problems similarly occur when an intermediate transfer drum is used as the intermediate transfer member.

SUMMARY OF THE INVENTION

An object of the present invention is to provide an image forming apparatus in which poor fixing of a fixing means regarding a transfer material can be avoided and the entire apparatus can be prevented from becoming bulky, and which can improve through-put of image formation.

The other object of the present invention will be apparent from the following detailed explanation of the invention.

DETAILED DESCRIPTION OF THE PREFERRED EMBODIMENTS

The present invention will now be explained in connection with embodiments thereof with reference to the accompanying drawings.

<First Embodiment>

Figure 1:
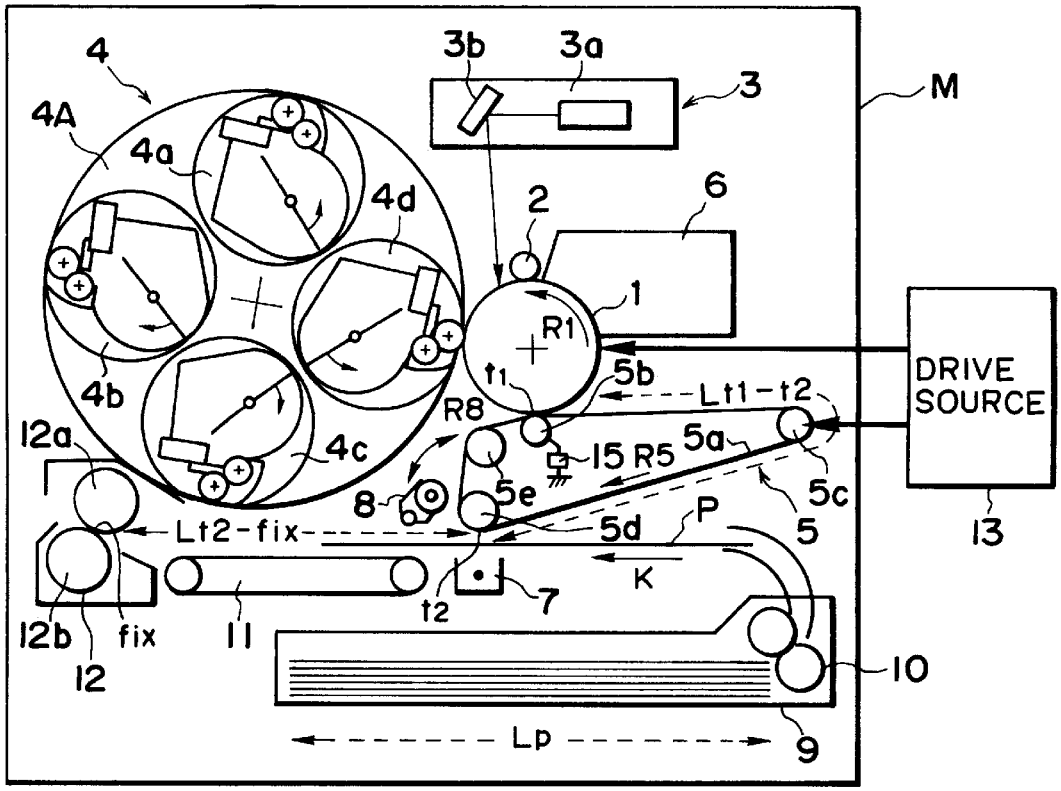
FIG. 1 is a schematic elevational sectional view of an image forming apparatus according to a first embodiment of the present invention.

FIG. 1 is an elevational sectional view showing a four color full-color laser beam printer as a full-color image forming apparatus.

First of all, a construction of the color image forming apparatus will be briefly explained with reference to FIG. 1.

The four color full-color laser beam printer shown in FIG. 1 (referred to as "image forming apparatus" hereinafter) a drum-shaped electrophotographic photosensitive member (referred to as "photosensitive drum" hereinafter) 1 as an image bearing member, which is rotated in a direction shown by the arrow R1.

Around the photosensitive drum 1, along its rotational direction, there are disposed, in order, a charge device 2, an exposure device 3, a developing means 4, an intermediate transfer device 5, and a cleaning device 6. Further, along a conveying direction of a transfer material P having great heat capacity such as a paper sheet or an OHT (transparent resin film for an overhead projector) on which an image is formed, in order from an upstream side thereof, there are disposed a sheet supply cassette 9, a sheet supply roller 10, a second transfer device 7, a convey device 11 and a fixing device 12.

Now, various elements will be described from the photosensitive drum 1.

The photosensitive drum 1 is constituted by a cylindrical substrate made of aluminum, and a photosensitive layer obtained by coating photo-conductive substance on the cylindrical substrate. The photo-conductive substance may be OPC (organic photo-semiconductor), A-Si (amorphous silicon), CdS (cadmium sulfide) or Se (selenium). The photosensitive drum 1 is rotatably supported by a main body M of the apparatus and is rotated in the direction R1 by a drive means (not shown) at a predetermined process speed.

In FIG. 1, the charge device 2 comprises a charge roller contacted with a surface of the photosensitive drum 1, and a charge bias power source (not shown) for applying charging voltage to the charge roller. The charge device 2 serves to uniformly charge the surface of the photosensitive drum 1 with predetermined potential having negative polarity.

The exposure device 3 has a light source 3*a* for emitting a laser beam, a polygon mirror (not shown), and a reflection mirror 3*b*. The laser beam generated from the light source 3*a* in response to image information scan the surface of the photosensitive drum 1 through the polygon mirror and the reflection mirror to expose the surface of the drum. By effecting such exposure, charges are removed from portions on which the laser beam is scanned, thereby forming an electrostatic latent image on the surface of the photosensitive drum 1. Thereafter, the electrostatic latent image is sequentially or successively developed with yellow toner, magenta toner, cyan toner and black toner in order, for example.

The developing means 4 serves to develop the electrostatic latent image on the photosensitive drum 1. The developing means 4 comprises a rotary 4A rotatably supported by the main body M of the apparatus, and four developing devices mounted on the rotary, i.e., developing devices 4*a*, 4*b*, 4*c* and 4*d* for containing yellow color toner, magenta color toner, cyan color toner and black color toner, respectively. In the developing means 4, by rotating the rotary 4A, the developing device to be used for development of the electrostatic latent image on the photosensitive drum 1 is brought to a developing station where said developing device is opposed to the surface of the photosensitive drum 1, with the result that the toner is adhered to the electrostatic latent image to develop (visualize) the latent image as a toner image.

The intermediate transfer device 5 comprises an endless intermediate transfer belt (intermediate transfer member) 5*a*, and a drive roller 5*c*, a second transfer counter roller 5*d* and a driven roller 5*e*, around which the intermediate transfer belt are supported. Further, the intermediate transfer device 5 includes a first transfer roller 5*b* for biasing a rear surface of the intermediate transfer belt 5*a* to urge the intermediate transfer belt against the surface of the photosensitive drum 1. When the intermediate transfer belt is urged against the photosensitive drum, a first transfer portion (first transfer position) $t_1$ is formed therebetween. The intermediate transfer belt 5*a* is an endless belt formed from a rubber sheet made of EPDM (ethylene-propylene-diene tri-copolymer), NBR (nitrile-butadiene rubber), urethane or silicone rubber or a flexible sheet made of polyvinylidene fluoride (PVdF) or polyethylene terephthalate (PET). The intermediate transfer belt 5*a* is rotated in a direction shown by the arrow R5 by rotation of the drive roller 5*c* driven by a drive source 13. Further, first transfer bias from a first transfer bias power source 15 is applied to the intermediate transfer belt 5*a* via the first transfer roller (first transfer means) 5*b*. The toner image on the surface of the photosensitive drum 1 is firstly-transferred onto the surface of the intermediate transfer belt 5*a* at the first transfer portion $t_1$ by rotation of the intermediate transfer belt 5*a* effected in synchronous with the photosensitive drum 1 and application of the first transfer bias to the first transfer roller 5*b*.

The cleaning device 6 has a cleaning blade (not shown) so that residual toner (referred to as "firstly-transferring residual toner" hereinafter) remaining on the surface of the photosensitive drum 1 after the firstly-transferring is removed by the cleaning blade.

By effecting the above-mentioned series of processes (charging exposure, developing, firstly-transferring, and cleaning), the yellow toner image on the photosensitive drum 1 is firstly-transferred. By repeating, the similar series of processes successively regarding the remaining colors, i.e., magenta, cyan and black, the four color toner images are successively firstly-transferred onto the surface of the intermediate transfer belt 5*a* in a superimposed fashion at the first transfer portion $t_1$.

In the first embodiment, the second transfer device 7 utilizes a corona charger (second transfer means). The corona charger is opposed to the second transfer counter roller 5*d* to form a second transfer portion (second transfer position) $t_2$ therebetween. Second transfer bias from a second transfer bias power source (not shown) is applied to the corona charger. As a result, the four color toner images on the intermediate transfer belt 5*a* are secondary-transferred onto the transfer material P collectively. Incidentally, the transfer material P is conveyed from the sheet supply cassette 9 in a direction shown by the arrow K by means of the sheet supply roller 10 and the like and is supplied to the second transfer portion $t_2$.

The cleaner 8 can be engaged by and disengaged from the surface of the intermediate transfer belt 5*a* and serves to remove residual toner (referred to as "secondary-transferring residual toner" hereinafter) remaining on the surface of the intermediate transfer belt 5*a* after the secondary-transferring.

The convey device 11 serves to convey the transfer material P toward the fixing device 12 after the secondary-transferring.

The fixing device (fixing means) 12 has a fixing portion "fix" defined by a fixing roller 12*a* and a pressure roller 12*b*. The four color toner images are fixed to the surface of the transfer material P with heat and pressure while the transfer material is being passed through the fixing portion "fix".

After the toner images were fixed, the transfer material P is discharged onto a discharge tray (not shown) by convey rollers (not shown) and discharge rollers (not shown).

In the color image forming apparatus according to the first embodiment, in addition to the above, when it is assumed that a peripheral length of the intermediate transfer belt 5*a* is L, a length of the transfer material P (predetermined thick sheet 105 g/cm$^2$ or OHT) in the conveying direction is $L_p$, a length of the toner image to be transferred to the intermediate transfer belt 5*a* (and the transfer material P) in the shifting direction of the intermediate transfer belt 5*a* (and the transfer material P) is $L_p'$, a distance between the first transfer portion $t_1$ and the second transfer portion $t_2$ along the shifting (rotating) direction of the intermediate transfer belt 5*a* is $L_{t1\text{-}t2}$, and a distance between the second transfer portion $t_2$ and the fixing portion fix along the shifting direction of the transfer material P is $L_{t2\text{-}fix}$, it is selected that the following relation is established:

$$L_{t1\text{-}t2}>L_p' \text{ and } L_p>L_{t2\text{-}fix} \quad (1)$$

And, a conveying speed of the transfer material in the secondary-transferring is decreased.

In the shifting direction of the intermediate transfer belt 5*a*, before and after the toner image transferred to the intermediate transfer belt 5*a* (transfer material P), fog toner on the photosensitive drum 1 may be transferred onto the intermediate transfer belt 5*a*. In such a case, immediately after the toner image is completely transferred to the intermediate transfer belt 5*a*, if the speed of the intermediate transfer belt 5*a* is decreased, the fog toner would be transferred onto a non-image area of the transfer material P. Accordingly, it is more preferable that the following relation (2) is established:

$$L_{t1\text{-}t2}>L_p>L_{t2\text{-}fix} \quad (2)$$

Now, an operation after the above-mentioned setting was effected will be explained.

First of all, the first color yellow toner image is formed on the surface of the photosensitive drum 1, and then, the toner image is firstly-transferred onto the intermediate transfer belt 5*a* at the first transfer portion $t_1$. Similarly, a second color magenta toner image, a third color cyan toner image and fourth color black toner image are firstly-transferred onto the intermediate transfer belt 5*a* successively, thereby superimposing the four color toner images on the intermediate transfer belt 5*a*.

In the present invention, as shown in the above relation (1), since $L_{t1\text{-}t2}>L_p'$, at the time when the firstly-transferring of the fourth color toner image at the first transfer portion $t_1$ is completely finished, a tip end of the transfer material P (toner image tip end) does not enter into the second transfer portion $t_2$, and thus, at this point, the speed of the intermediate transfer belt 5*a* can be decreased. That is to say, after the firstly-transferring and before the secondary-transferring, it is not required that the intermediate transfer belt 5*a* is idly rotated by one revolution with the result that the through-put of image formation is not worsened.

Figure 3:
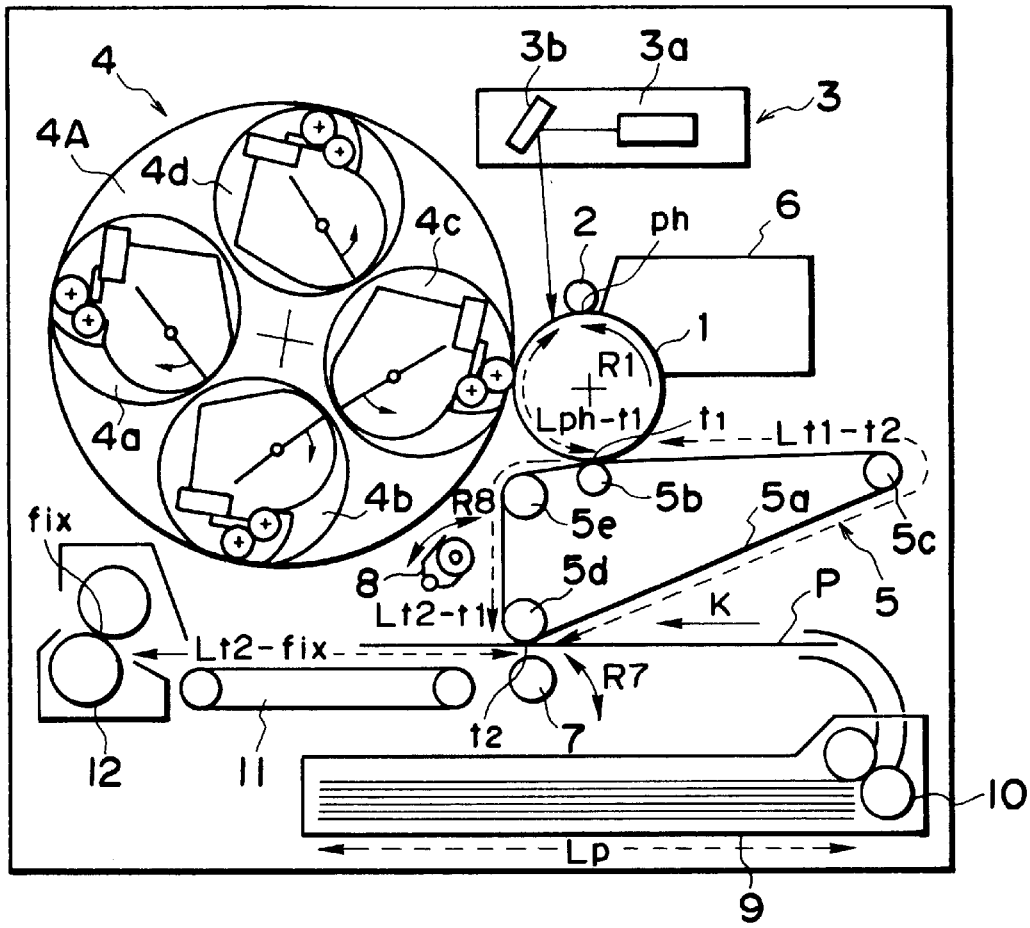
FIG. 3 is a schematic elevational sectional view of an image forming apparatus according to a second embodiment of the present invention.

In the present invention, immediately after the firstly-transferring of the fourth color toner image is completely finished, the speed of the intermediate transfer belt 5*a* is decreased from a predetermined first speed to a second speed, and, after speed reduction, the secondary-transferring to the supplied transfer material is effected at a low speed corresponding to the second speed. When the second transfer device is the second transfer roller 7 as shown in FIG. 3, the speed of the roller is decreased similar to the intermediate transfer belt 5*a*. Following to the reduced speed secondary-transferring process, the transfer material P enters into the fixing device a speed of which is decreased to a speed substantially the same as the second speed of the intermediate transfer belt 5*a* (i.e., decreased from a third speed to a fourth speed). Thus, since the fixing regarding the transfer material is effected at a low speed, much heat amount more than that in the normal speed (third speed) is given to the transfer material P from the fixing device 12.

As a result, even regarding the transfer material P such as the thick sheet or OHT for which the adequate fixing ability cannot be obtained by the normal speed (third speed), the optimum fixing of the toner image can be achieved, and, following to the reduced speed secondary-transferring process, the reduced speed fixing can be performed. Accordingly, unlike to the case where the secondary-transferring is effected when the intermediate transfer belt 5*a* is driven at the normal speed (first speed) and thereafter the fixing is effected at the reduced speed (fourth speed), it is not needed that the distance between the second transfer portion $t_2$ and the fixing portion fix is set to be greater than the length $L_p$ of the transfer material in the conveying direction thereof in order to decrease the fixing speed from the third speed to the fourth speed, that is, $L_p>L_{t2\text{-}fix}$ can be set, with the result that the convey device 12 can be made compact accordingly, thereby making the main body M of the apparatus compact.

Incidentally, the first speed is substantially the same as the third speed, and the second speed is substantially the same as the fourth speed. However, in order that the fixing device 12 does not pull the transfer material P during the secondary-transferring, it is preferable that the first speed becomes slower than the third speed and the second speed becomes slower than the fourth speed to the extent that the poor image is not generated.

As mentioned above, in the present invention, although there is the process in which the secondary-transferring is effected at the reduced speed, in general, the optimum condition for the transfer bias is based on how much Coulomb (of charges) can be transmitted per unit area. Accordingly, in the case where the transfer current of about 10 $\mu$A is required when the intermediate transfer belt 5*a* is driven at the normal speed (first speed), if the speed of the intermediate transfer belt 5*a* is changed from the first speed to the second speed (for example, reduced to about ½), the optimum running current becomes about 5 $\mu$A. Thus, depending upon the second transfer bias, when the transfer bias during the secondary-transferring is changed to a value different from the transfer bias value during the normal speed operation, better image quality can be obtained.

Further, regarding the normal transfer material P (105 g/cm$^2$ or less), the firstly-transferring is effected at the normal speed (first speed) of the intermediate transfer belt 5*a*, and, then, the secondary-transferring is effected at the normal speed (first speed). After the secondary-transferring, the toner images are fixed onto the transfer material P by the fixing device 12 at the normal speed (third speed).

Further, in the present invention, the photosensitive drum 1 and the intermediate transfer belt 5*a* are driven by the same (common) drive source 13. With this arrangement, it can be prevented that the photosensitive drum 1 and the intermediate transfer belt 5*a* are slid relative to each other due to speed difference (small difference in deceleration and/or acceleration) which would be generated if the drum and the belt are driven by different drive sources at variable speeds in synchronous with each other. Thus, the electrostatic damage (memory) from generating in the photosensitive drum 1 or the intermediate transfer belt 5*a* due to the relative sliding is prevented.

Figure 2A:
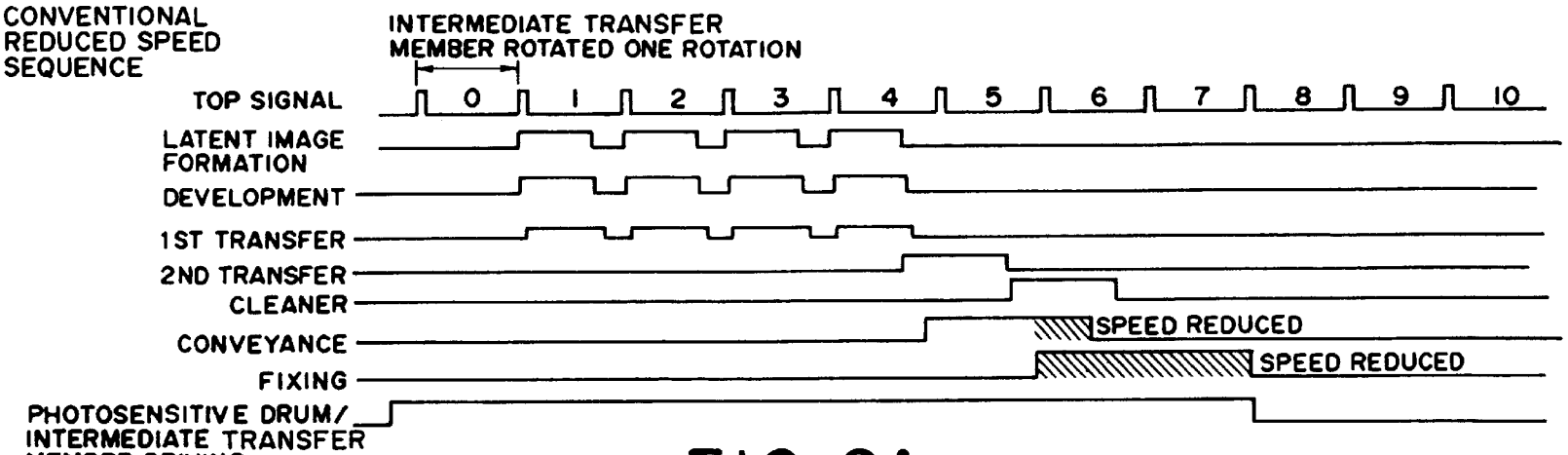
FIG. 2A is a view showing a conventional image forming sequence.
Figure 2B:
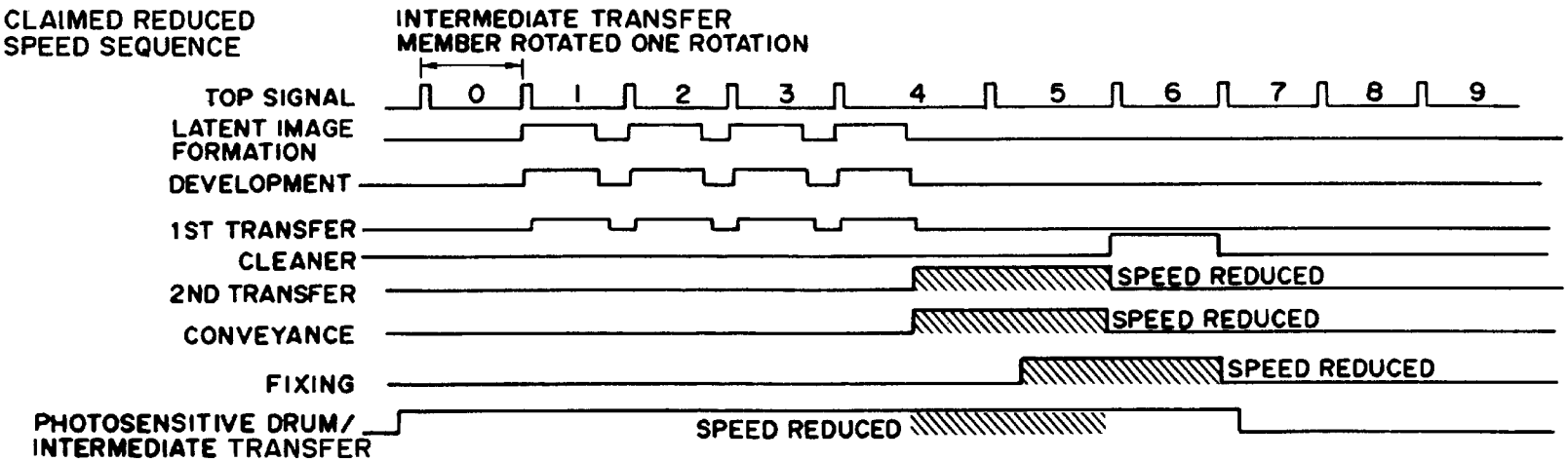
FIG. 2B is a view showing an image forming sequence according to the present invention.

FIG. 2A shows a conventional image forming (reduced speed printing) sequence, and FIG. 2B shows an image forming (reduced speed printing) sequence according to the present invention. In FIGS. 2A and 2B, hatched zones show areas within which speed reduction is effected. In the present invention, although the photosensitive drum 1 and the intermediate transfer belt 5*a* are driven by the same drive source 13, the fixing device 12 is driven by a drive source (not shown) different from the drive source 13, and, immediately after the trail end of the transfer material P passes through the second transfer portion $t_2$, the speeds of the photosensitive drum 1 and the intermediate transfer belt 5*a* are returned from the second speeds to the normal speeds (first speeds). Accordingly, during the reduced speed fixing effected by the fixing device 12, the intermediate transfer belt 5*a* can be initialized at the normal speed. As a result, since the next image formation can be performed at the time when the transfer material P is discharged (after the reduced speed fixing effected by the fixing device 12), the throughput of continuous image formation in which images are formed on a plurality of transfer materials P can be improved.

The reduced speed of the fixing device 12 (i.e., fourth speed) is not limited to a single value, but may have plural values in dependence upon the kind of transfer material P (fixing ability). That is to say, the reduced speed may be changed between the thick sheet (105 g/cm$^2$ or more) and OHT. For example, the fixing speed for the thick sheet may be ½ of the first speed, and the fixing speed for OHT may be ⅓ of the first speed. In this case, the speed of the intermediate transfer belt 5*a* may have plural values as is in the fixing device 12. The selection of the reduced speed can be effected by any switch provided in the image forming apparatus, which switch may be a conventional sensor of permeable type capable of detecting OHT, for example.

<Second Embodiment>

FIG. 3 shows a second embodiment of the present invention, in which, in place of the corona charger, a second transfer roller (second transfer means) which can be engaged by and disengaged from the intermediate transfer belt 5*a* along a direction shown by the arrow R7 is used as the second transfer device 7. In comparison with the corona charger, the second transfer roller has advantages that the transferring with lower voltage can be effected and ozone (which is generated from the corona charger) is not generated, thereby reducing the cost and not worsening environment.

However, in the case where the continuous image formation at the normal speed is effected by using the above-mentioned relation (1) (preferably, relation (2)), at the time when the second transfer roller abuts against the intermediate transfer belt 5*a*, the electrostatic latent image in the next image formation may be formed on the photosensitive drum 1. In this case, the shock generated when the second transfer roller abuts against the intermediate transfer belt 5*a* will deviate such electrostatic latent image, thereby affecting a bad influence upon the next image and so on. When it is assumed that a distance between an exposure portion (exposure position) ph where the electrostatic latent image is formed by the exposure device 3 and the first transfer portion $t_1$, along the shifting direction of the photosensitive drum 1 is $L_{ph\text{-}t1}$, by setting the distance $L_{ph\text{-}t1}$ to become greater that the distance $L_{t2\text{-}t1}$ between the second transfer portion $t_2$ and first transfer portion $t_1$, that is, by setting the exposure portion ph, first transfer portion $t_1$, and second transfer portion $t_2$ to satisfy the following relation (3), such bad influence can be avoided:

$$L_{ph\text{-}t1} > L_{t2\text{-}t1} \quad (3)$$

By setting as mentioned above, at the time when the second transfer roller abuts against the intermediate transfer belt 5*a*, the next electrostatic latent image is not formed, with the result that the shock generated when the second transfer roller abuts against the intermediate transfer belt 5*a* can be prevented from deviating electrostatic latent image. Of course, immediately after the second transfer roller abuts against the intermediate transfer belt 5*a*, the electrostatic latent image may be formed. However, in consideration of the fact that the shock due to abutment continues about 10 to 150 msec, it is preferable that the exposure portion ph, first transfer portion $t_1$, and second transfer portion $t_2$ are set so that the electrostatic latent image is formed when about 70 msec is elapsed after the second transfer roller abuts against the intermediate transfer belt 5*a*.

Figure 4:
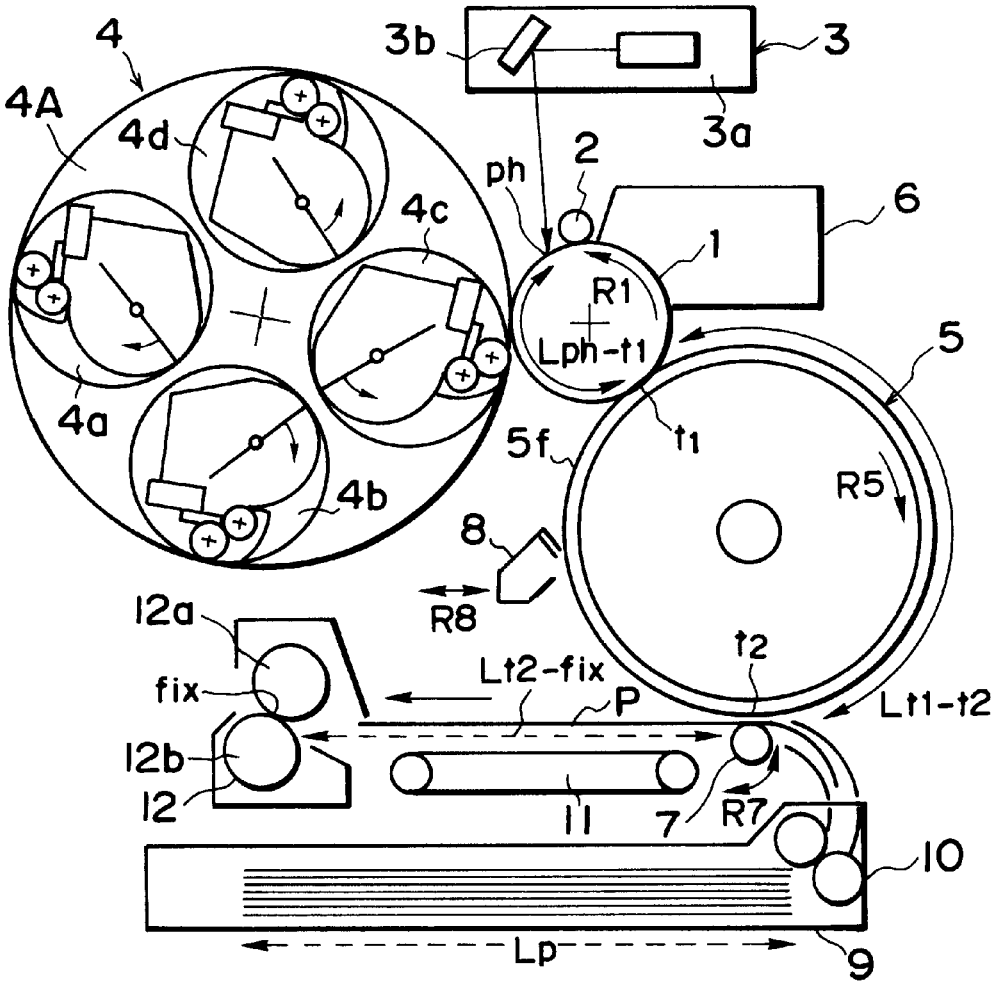
FIG. 4 is a schematic elevational sectional view of an image forming apparatus according to a third embodiment of the present invention.
Figure 5:
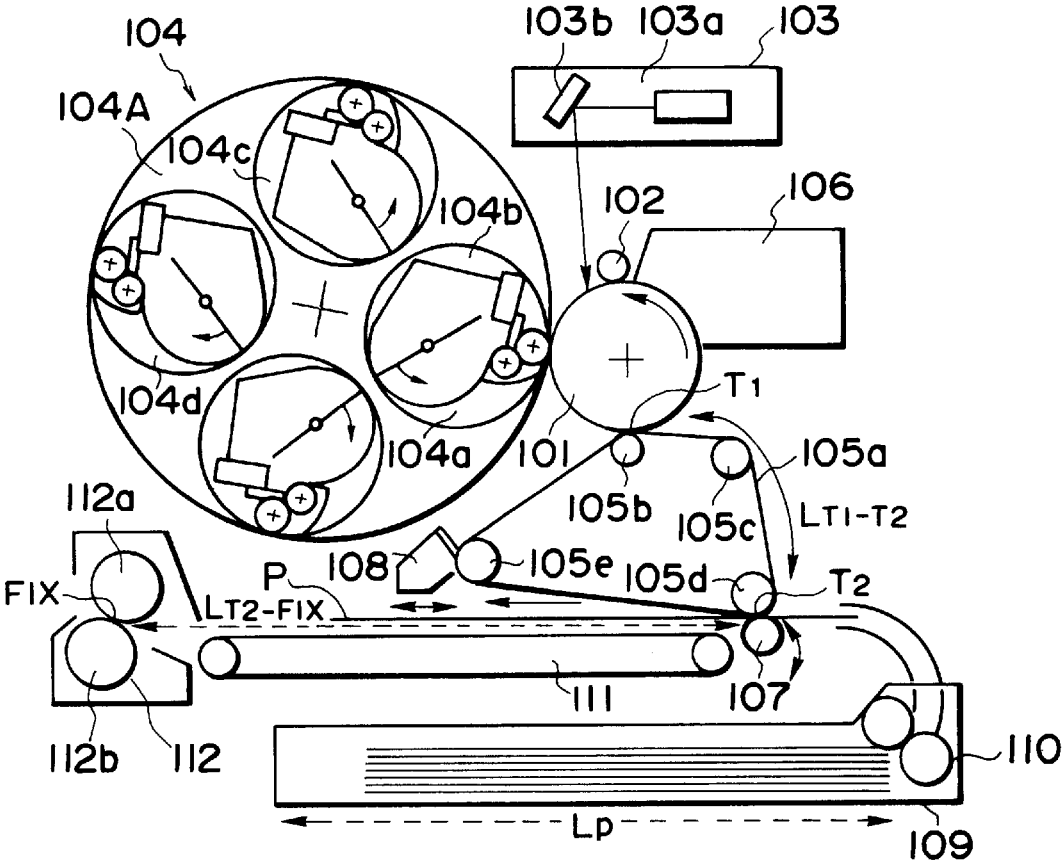
FIG. 5 is a schematic elevational sectional view of a conventional image forming apparatus.

In the above-mentioned first and second embodiments, while an example that the intermediate transfer belt 5*a* is used as the intermediate transfer device 5 was explained, even when an intermediate transfer drum 5*f* is used as shown in FIG. 4, the same effect can be expected. Further, in place of the photosensitive drum 1, a photosensitive belt may be used as the image bearing member.

What is claimed is:

1. An image forming apparatus comprising:

a moveable image bearing member for bearing a toner image;

a moveable intermediate transfer member onto which the toner image on said image bearing member is transferred at a first transfer position and in which a moving speed of which can be switched between a first moving speed and a second moving speed slower than said first moving speed; and a moveable fixing means for fixing the toner image onto a transfer material at a fixing position after the toner image on said intermediate transfer member is transferred onto the transfer material at a second transfer position, said fixing means effecting fixing at a first fixing speed when the toner image on said intermediate transfer member is transferred onto the transfer material at said first moving speed, and effecting fixing at a second fixing speed slower than said first fixing speed when the toner image on said intermediate transfer member is transferred onto the transfer material at said second moving speed;

wherein a distance from said first transfer position to said second transfer position along a moving direction of said intermediate transfer member is longer than a length of the toner image on said intermediate transfer member in the moving direction thereof, and a distance from said second transfer position to said fixing position is shorter than a length of the transfer material along a conveying direction thereof; and after the toner image is transferred from said image bearing member to said intermediate transfer member and before the toner image on said intermediate transfer member reaches said second transfer position, the toner image on said intermediate transfer member does not pass through said first transfer position, and the moving speed of said intermediate transfer member can be switched from said first moving speed to said second moving speed.

2. An image forming apparatus according to claim 1, wherein when the transfer material is a transparent film and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

3. An image forming apparatus according to claim 1, wherein when a basis weight of the transfer material is 105 $g/cm^2$ or more and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

4. An image forming apparatus according to claim 1, wherein said image bearing member and said intermediate transfer member are driven by a common drive source.

5. An image forming apparatus according to claim 4, further comprising an exposure means for exposing a surface of said image bearing member at an exposure position, wherein a distance from said exposure position to said first transfer position in a moving direction of said image bearing member is greater than a distance from said second transfer position to said first transfer position in the moving direction of said intermediate transfer member.

6. An image forming apparatus according to claim 1 or 4, wherein, after the toner image is transferred from said intermediate transfer member to the transfer material, the speed of said intermediate transfer member is switched from said second moving speed to said first moving speed.

7. An image forming apparatus according to claim 1, wherein said fixing means has a pair of rollers.

8. An image forming apparatus according to claim 1, further comprising a first transfer means for applying voltage to said intermediate transfer member in order to transfer the toner image from said image bearing member to said intermediate transfer member at said first transfer position.

9. An image forming apparatus according to claim 8, wherein said first transfer means has a roller.

10. An image forming apparatus according to claim 8, further comprising a second transfer means for transferring the toner image from said intermediate transfer member to the transfer material.

11. An image forming apparatus according to claim 10, wherein said second transfer means has a roller.

12. An image forming apparatus according to claim 1, wherein said first moving speed is faster than said first fixing speed.

13. An image forming apparatus according to claim 1 or 12, wherein said second moving speed is faster than said second fixing speed.

14. An image forming apparatus according to claim 1, wherein said image bearing member is adapted to bear plural color toner images, and the plural color toner images on said image bearing member are sequentially transferred onto said intermediate transfer member in a superimposed fashion at said first transfer position, and then the plural color toner images on said intermediate transfer member are transferred onto the transfer material at said second transfer position.

15. An image forming apparatus comprising:

a moveable image bearing member for bearing a toner image;

a moveable intermediate transfer member onto which the toner image on said image bearing member is transferred at a first transfer position and in which a moving speed of which can be switched between a first moving speed and a second moving speed slower than said first moving speed; and a moveable fixing means for fixing the toner image onto a transfer material at a fixing position after the toner image on said intermediate transfer member is transferred onto the transfer material at a second transfer position, said fixing means effecting fixing at a first fixing speed when the toner image on said intermediate transfer member is transferred onto the transfer material at said first moving speed, and effecting fixing at a second fixing speed slower than said first fixing speed when the toner image on said intermediate transfer member is transferred onto the transfer material at said second moving speed;

wherein a distance from said first transfer position to said second transfer position along a moving direction of said intermediate transfer member is longer than a length of the transfer material in a conveying direction thereof, and a distance from said second transfer position to said fixing position in the conveying direction of the transfer material is shorter than the length of the transfer material along the conveying direction thereof; and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member can be switched from said first moving speed to said second moving speed.

16. An image forming apparatus according to claim 15, wherein when the transfer material is a transparent film and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

17. An image forming apparatus according to claim 15, wherein when a basis weight of the transfer material is 105 g/cm$^2$ or more and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

18. An image forming apparatus according to claim 15, wherein said image bearing member and said intermediate transfer member are driven by a common drive source.

19. An image forming apparatus according to claim 18, further comprising an exposure means for exposing a surface of void image bearing member at an exposure position, wherein a distance from said exposure position to said first transfer position in a moving direction of said image bearing member is greater than a distance from said second transfer position to said first transfer position in the moving direction of said intermediate transfer member.

20. An image forming apparatus according to claim 15 or 18, wherein, after the toner image is transferred from said intermediate transfer member to the transfer material, the speed of said intermediate transfer member is switched from said second moving speed to said first moving speed.

21. An image forming apparatus according to claim 15, wherein said fixing means has a pair of rollers.

22. An image forming apparatus according to claim 15, further comprising a first transfer means for applying voltage to said intermediate transfer member in order to transfer the toner image from said image bearing member to said intermediate transfer member at said first transfer position.

23. An image forming apparatus according to claim 22, wherein said first transfer means has a roller.

24. An image forming apparatus according to claim 22, further comprising a second transfer means for transferring the toner image from said intermediate transfer member to the transfer material.

25. An image forming apparatus according to claim 24, wherein said second transfer means has a roller.

26. An image forming apparatus according to claim 15, wherein said first moving speed is faster than said first fixing speed.

27. An image forming apparatus according to claim 15 or 26, wherein said second moving speed is faster than said second fixing speed.

28. An image forming apparatus according to claim 15, wherein said image bearing member is adapted to bear plural color toner images, and the plural color toner images on said image bearing member are sequentially transferred onto said intermediate transfer member in a superimposed fashion at said first transfer position, and then the plural color toner images on said intermediate transfer member are transferred onto the transfer material at said second transfer position.

29. An image forming apparatus comprising:

a moveable image bearing member for bearing a toner image;

a moveable intermediate transfer member onto which the toner image on said image bearing member is transferred at a first transfer position and in which a moving speed of which can be switched between a first moving speed at which the toner image on said image bearing member is transferred onto said intermediate transfer member and a second moving speed slower than said first moving speed; and moveable fixing means for fixing the toner image onto a transfer material at a fixing position after the toner image on said intermediate transfer member is transferred onto the transfer material at a second transfer position, said fixing means effecting fixing at a speed slower than said first moving speed, wherein a distance from said first transfer position to said second transfer position along a moving direction of said intermediate transfer member is longer than a length of the toner image on said intermediate transfer member in the moving direction thereof, and a distance from said second transfer position to said fixing position is shorter than a length of the transfer material along a conveying direction thereof; and after the toner image is transferred from said image bearing member to said intermediate transfer member and before the toner image on said intermediate transfer member reaches said second transfer position, the toner image on said intermediate transfer member does not pass through said first transfer position, and the moving speed of said intermediate transfer member can be switched from said first moving speed to said second moving speed.

30. An image forming apparatus according to claim 29, wherein when the transfer material is a transparent film and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

31. An image forming apparatus according to claim 29, wherein when a basis weight of the transfer material is 105 g/cm$^2$ or more and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

32. An image forming apparatus according to claim 29, wherein said image bearing member and said intermediate transfer member are driven by a common drive source.

33. An image forming apparatus according to claim 32, further comprising an exposure means for exposing a surface of said image bearing member at an exposure position, wherein a distance from said exposure position to said first transfer position in a moving direction of said image bearing member is greater than a distance from said second transfer position to said first transfer position in the moving direction of said intermediate transfer member.

34. An image forming apparatus according to claim 29 or 32, wherein, after the toner image is transferred from said intermediate transfer member to the transfer material, the speed of said intermediate transfer member is switched from said second moving speed to said first moving speed.

35. An image forming apparatus according to claim 29, wherein said fixing means has a pair of rollers.

36. An image forming apparatus according to claim 29, further comprising a first transfer means for applying voltage to said intermediate transfer member in order to transfer the toner image from said image bearing member to said intermediate transfer member at said first transfer position.

37. An image forming apparatus according to claim 36, wherein said first transfer means has a roller.

38. An image forming apparatus according to claim 36, further comprising a second transfer means for transferring the toner image from said intermediate transfer member to the transfer material.

39. An image forming apparatus according to claim 38, wherein said second transfer means has a roller.

40. An image forming apparatus according to claim 29, wherein said image bearing member is adapted to bear plural color toner images, and the plural color toner images on said image bearing member are sequentially transferred onto said intermediate transfer member in a superimposed fashion at said first transfer position, and then the plural color toner images on said intermediate transfer member are transferred onto the transfer material at said second transfer position.

41. An image forming apparatus comprising:

a moveable image bearing member for bearing a toner image;

a moveable intermediate transfer member onto which the toner image on said image bearing member is transferred at a first transfer position and in which a moving speed of which can be switched between a first moving speed at which the toner image on said image bearing member is transferred onto said intermediate transfer member and a second moving speed slower than said first moving speed; and moveable fixing means for fixing the toner image onto a transfer material at a fixing position after the toner image on said intermediate transfer member is transferred onto the transfer material at a second transfer position, said fixing means effecting fixing at a speed slower than said first moving speed, wherein a distance from said first transfer position to said second transfer position along a moving direction of said intermediate transfer member is longer than a length of the transfer material in a conveying direction thereof, and a distance from said second transfer position to said fixing position in the conveying direction of the transfer material is shorter than the length of the transfer material along the conveying direction thereof; and after the toner image is transferred from said image bearing member to said intermediate transfer member and before the toner image on said intermediate transfer member reaches said second transfer position, the toner image on said intermediate transfer member does not pass through said first transfer position, and the moving speed of said intermediate transfer member can be switched from said first moving speed to said second moving speed.

42. An image forming apparatus according to claim 41, wherein when the transfer material is a transparent film and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

43. An image forming apparatus according to claim 41, wherein when a basis weight of the transfer material is 105 $g/cm^2$ or more and after the toner image is transferred from said image bearing member to said intermediate transfer member and before the toner image on said intermediate transfer member reaches said second transfer position, the toner image on said intermediate transfer member does not pass through said first transfer position and the moving speed of said intermediate transfer member is switched from said first moving speed to said second moving speed.

44. An image forming apparatus according to claim 41, wherein said image bearing member and said intermediate transfer member are driven by a common drive source.

45. An image forming apparatus according to claim 44, further comprising an exposure means for exposing a surface of said image bearing member at an exposure position, wherein a distance from said exposure position to said first transfer position in a moving direction of said image bearing member is greater than a distance from said second transfer position to said first transfer position in the moving direction of said intermediate transfer member.

46. An image forming apparatus according to claim 41 or 44, wherein, after the toner image is transferred from said intermediate transfer member to the transfer material, the speed of said intermediate transfer member is switched from said second moving speed to said first moving speed.

47. An image forming apparatus according to claim 41, wherein said fixing means has a pair of rollers.

48. An image forming apparatus according to claim 41, further comprising a first transfer means for applying voltage to said intermediate transfer member in order to transfer the toner image from said image bearing member to said intermediate transfer member at said first transfer position.

49. An image forming apparatus according to claim 48, wherein said first transfer means has a roller.

50. An image forming apparatus according to claim 48, further comprising a second transfer means for transferring the toner immage from said intermediate transfer member to the transfer material.

51. An image forming apparatus according to claim 50, wherein said second transfer means has a roller.

52. An image forming apparatus according to claim 41, wherein said image bearing member is adapted to bear plural color toner images, and the plural color toner images on said image bearing member are sequentially transferred onto said intermediate transfer member in a superimposed fashion at said first transfer position, and then the plural color toner images on said intermediate transfer member are transferred onto the transfer material at said second transfer position.

* * * * *

UNITED STATES PATENT AND TRADEMARK OFFICE

CERTIFICATE OF CORRECTION

PATENT NO. : 6,088,567

DATED : July 11, 2000

INVENTOR(S): TOSHIAKI MIYASHIRO, ET AL.

It is certified that error appears in the above-identified patent and that said Letters Patent is hereby corrected as shown below:

COLUMN 2:
Line 11, "image" should read --images--; and
Line 26, "transferred" should read --transferring--.

COLUMN 11:
Line 23, "void" should read --said--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*